US007459841B2

(12) United States Patent
Kojima et al.

(10) Patent No.: US 7,459,841 B2
(45) Date of Patent: Dec. 2, 2008

(54) ELECTRON BEAM APPARATUS, DISPLAY APPARATUS, TELEVISION APPARATUS, AND SPACER

(75) Inventors: Shinsuke Kojima, Kanagawa-ken (JP); Masahiro Tagawa, Kanagawa-ken (JP); Yoichi Ando, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 468 days.

(21) Appl. No.: 11/030,890

(22) Filed: Jan. 10, 2005

(65) Prior Publication Data

US 2005/0162065 A1 Jul. 28, 2005

(30) Foreign Application Priority Data

Jan. 22, 2004 (JP) ..... 2004-014468

(51) Int. Cl.
*H01J 31/12* (2006.01)
*H01J 63/04* (2006.01)

(52) U.S. Cl. ..... 313/495; 313/292; 313/238; 313/252

(58) Field of Classification Search ..... 313/292, 313/495
See application file for complete search history.

(56) References Cited

U.S. PATENT DOCUMENTS

| | | | | |
|---|---|---|---|---|
| 5,760,538 | A | 6/1998 | Mitsutake et al. | 313/422 |
| 6,274,972 | B1 | 8/2001 | Mitsutake et al. | 313/292 |
| 6,441,544 | B1 | 8/2002 | Ando et al. | 313/310 |
| 6,534,911 | B1 | 3/2003 | Ando | 313/496 |
| 6,759,802 | B2 | 7/2004 | Ando | 313/495 |
| 6,802,753 | B1 | 10/2004 | Ando et al. | 445/6 |
| 6,884,138 | B1 | 4/2005 | Ando et al. | 445/24 |
| 7,378,788 | B2 * | 5/2008 | Ando | 313/495 |
| 2002/0158571 | A1 | 10/2002 | Ando | 313/496 |
| 2002/0190633 | A1 | 12/2002 | Tagawa et al. | 313/483 |

(Continued)

FOREIGN PATENT DOCUMENTS

JP 8-180821 7/1996

(Continued)

OTHER PUBLICATIONS

Machine english translation of JP 2003-229056 to Hayama et al.*

(Continued)

*Primary Examiner*—Sikha Roy
(74) *Attorney, Agent, or Firm*—Fitzpatrick, Cella, Harper & Scinto

(57) ABSTRACT

To prevent an irregular shift of an electron beam emitted from an adjacent electron emitting device when preventing electrification of a spacer covered with a resistance film by using the spacer.

A spacer 3 is set along a row-directional wiring 5 connected to a plurality of electron emitting devices 8 of a first substrate and a resistance film 14 formed on the surface of the spacer 3 is brought into contact with and electrically connected to a conductive member 11 such as a metal backing on a second substrate 2 and the row-directional wiring 5 on the first substrate while the shape of the contact face between the resistance film 14 and the row-directional wiring 5 or the resistance film 14 and the conductive member 11 has a concave shape or convex shape to be almost symmetric with respect to the center line of the spacer 3.

7 Claims, 9 Drawing Sheets

U.S. PATENT DOCUMENTS

| | | | | |
|---|---|---|---|---|
| 2003/0164675 | A1 | 9/2003 | Ando | 313/495 |
| 2004/0080259 | A1 | 4/2004 | Ando | 313/495 |
| 2004/0212293 | A1 | 10/2004 | Ando et al.d | 313/495 |
| 2004/0227453 | A1 | 11/2004 | Ando et al. | 313/495 |
| 2004/0245916 | A1 | 12/2004 | Hiroike et al. | 313/495 |

FOREIGN PATENT DOCUMENTS

| | | | |
|---|---|---|---|
| JP | 2000-251708 | | 9/2000 |
| JP | 2000-285829 | | 10/2000 |
| JP | 2001-229810 | | 8/2001 |
| JP | 2003-229056 | | 8/2003 |
| JP | 2003-229057 | | 8/2003 |
| JP | 2003-317651 | | 11/2003 |
| JP | 2006093036 | A * | 4/2006 |
| WO | WO 03/092036 | A1 | 11/2003 |

OTHER PUBLICATIONS

Machine English translation of JP 2000285829 to Ando.*

* cited by examiner

ELECTRON BEAM APPARATUS, DISPLAY APPARATUS, TELEVISION APPARATUS, AND SPACER

BACKGROUND OF THE INVENTION

1. Field of the Invention

The present invention relates to an electron beam apparatus, an image display apparatus, a television apparatus, and a spacer used for an airtight vessel including these apparatuses, which are particularly preferably used for an electron beam apparatus having a plurality of electron emitting devices and a spacer covered with resistance films.

2. Related Background Art

In the case of an image forming apparatus constituted by a first substrate at the electron source side and a second substrate at the display face side which are faced with each other by keeping an interval, a spacer constituted by an insulating material is generally held between the first and second substrates in order to obtain a necessary atmospheric resistance. However, a problem occurs that the spacer is electrified to influence an electron trajectory nearby the spacer and to cause a luminescence position shift. This becomes a cause of image deterioration such as luminescence brightness deterioration or color ooze of a pixel nearby the spacer.

It is conventionally known to use a spacer covered with a resistance film in order to prevent the spacer from being electrified.

Specifically, the following spacers are known: a rib-like spacer covered with a resistance film, in which the resistance film is held between the wiring of a first substrate and the electrode of a second substrate so that the resistance film is directly pressure-welded to the wiring and the electrode; and a spacer covered with a resistance film, in which spacer electrodes are on the upside and the downside of the spacer so that the resistance film is in contact with the wiring and the electrode through the spacer electrodes (refer to Patent Document 1).

[Patent Document 1] Japanese Patent Application Laid-Open No. H08-180821

However, as a result of studying the image forming apparatus described in Patent Document 1 by the present inventor et al., we newly find that in the case of a spacer in which an end face of the spacer is covered with a resistance film, when directly pressure-welding the resistance film to the wiring of a first substrate and the electrode of a second substrate, electrification of the spacer may not be sufficiently canceled or the potential distribution of the surface of the spacer may show an unexpected distribution state.

It is difficult to specify the cause by which the above phenomena occur because the cause often depends on the fabrication process of a display apparatus. However, when a strain occurs on the wiring of the first substrate or the electrode of the second substrate or a foreign matter is present on it, a contact position between the resistance film of the spacer and the wiring or electrode is fluctuated depending on a place because the surface of the wiring or electrode is roughened or burrs, etc. It is found that the potential distribution is thus disordered. In particular, in the case of a wiring manufactured by an inexpensive manufacturing method, the surface shape may be locally different and the above imperfect electrical connection easily occurs.

In the above case, electrification of the spacer is not sufficiently solved and moreover, an irregular change occurs in the potential distribution of the surface of the spacer, and a trouble occurs that the trajectory of an electron beam does not conform to the design. Moreover, because the electron beam is accelerated from the first substrate toward the second substrate, a change of the trajectory remarkably appears due to a deflection force at the first substrate side compared to the second substrate side.

The deflection of the electron beam due to the potential distribution of the surface of the spacer at the first substrate side is more specifically described below by referring to FIGS. 11 and 12.

FIG. 11 is a local sectional view of a rib-like spacer 3 covered with a resistance film 14 when inserting it along a wiring 5 of the first substrate when viewed from the orthogonal direction. FIG. 12 shows an enlarged contact portion between the resistance film 14 and the wiring 5 shown in FIG. 11, which is a schematic view showing the potential distribution and electron trajectory when the contact position between the spacer and the wiring is shifted from the center because the surface of the wiring 5 is roughened.

As shown in FIG. 12, relations of the contact position between the resistance film 14 and the wiring 5 are asymmetric to the center of the spacer 3. When assuming distances between the center and contact ends of the spacer 3 as L1 and L2, the potential at the L1 side is raised by a voltage drop due to the resistance between L2 and L1 (equal potential line 20). Thus, the trajectory of an electron beam emitted from an electron emitting device 8 at the L1 side shows a behavior different from the trajectory of electrons emitted from the electron emitting device at the L2 side. As a result, images differ (are deflected) at L1 side and L2 side because the attainment position of the electron beam is shifted (electron beam trajectory 18).

However, in the case of the image forming apparatus described in Patent Document 1, in which the spacer electrodes are set at the upside and downside of the spacer covered with the resistance film and the resistance film is connected to the wiring of the first substrate and the electrode of the second substrate through the spacer electrodes, because the spacer electrodes are exposed to the sides of the spacer, electric field distribution occurs nearby the exposed portions. Though the electric field distribution is almost uniform in the longitudinal direction of the spacer, it appears strongly compared to the case in which the spacer electrodes are not exposed. Therefore, it is found that the attainment position of an electron beam emitted from an adjacent electron emitting device is easily greatly disordered due to a shift of alignment caused when setting the spacer, and moreover, this becomes a cause of emission, and the quality of an image is likely to be greatly deteriorated. To prevent this, it is necessary to set the spacer electrodes so as not to be exposed to the sides of the spacer or accurately set the spacer. Anyway, this causes cost increase.

SUMMARY OF THE INVENTION

An electron beam apparatus of the present invention is an electron beam apparatus including a first substrate having a plurality of electron emitting devices and a first conductor which is positioned and held between some of the plurality of electron emitting devices and which is set at a lower potential, a second substrate disposed in opposition to the first substrate and having a second conductor set at a potential higher than that of the first conductor, and a spacer covered with a resistance film disposed between the first substrate and the second substrate along the first conductor and electrically connected to the first conductor and the second conductor, in which a surface covered with the resistance film of the spacer at the side connected to the first conductor and/or the second conductor has a concave portion or a convex portion to be almost symmetric (or close to being symmetric) with respect to a center line of the spacer parallel to a normal line of the first substrate and/or second substrate. And, the center line is within a cross section of the spacer along a plane including the light emitting devices disposed in sandwiching the spacer and parallel to the normal line direction.

The structure of a spacer of the present invention is a spacer structure which is disposed in contact with a first conductor and a second conductor set at potentials different from each other and in which a base material is covered with a resistance film, in which the surface covered with the resistance film of the spacer at the side to be connected to the first conductor and/or second conductor is rectangular and a concave portion or convex portion to be almost symmetric with respect to the center line of the spacer for sectionalizing the short side of the face vertically in the longitudinal direction of the face is formed on the face.

According to the present invention, it is possible to restrain the fluctuation of potential due to a voltage drop according to the difference of a contact position from the center of a spacer by controlling the contact state between the spacer and the first conductor of a first substrate or the second conductor of a second substrate and obtain a desired electron beam trajectory in an electron beam apparatus.

Moreover, by forming positive irregularity equal to or more than the fluctuation {surface roughness (including local protrusion)} depending on a method for fabricating a first conductor and a second conductor on the contact face between the resistance film of a spacer and the first and second conductors, it is possible to positively control the contact state. By applying these, a desired electron beam trajectory nearby the spacer is obtained and can be provided preferable image display free from a deflection due to the spacer when using an electron beam apparatus as an image display apparatus.

DESCRIPTION OF THE PREFERRED EMBODIMENTS

First, functions of the present invention are described below.

In the case of the present invention, when preventing electrification of a spacer by using a spacer covered with a resistance film, occurrence of irregular potential distribution on the surface of the spacer is controlled and an irregular shift of an electron beam emitted from an adjacent electron emitting device is prevented by forming a concave portion or convex portion on at least either of a contact portion between the resistance film of the spacer and the first conductor of a first substrate and a contact portion between the resistance film of the spacer and the second conductor of a second substrate and by positively controlling a contact position even if the surface of the first conductor or second conductor with which the spacer contacts is slightly roughened.

Figure 1:
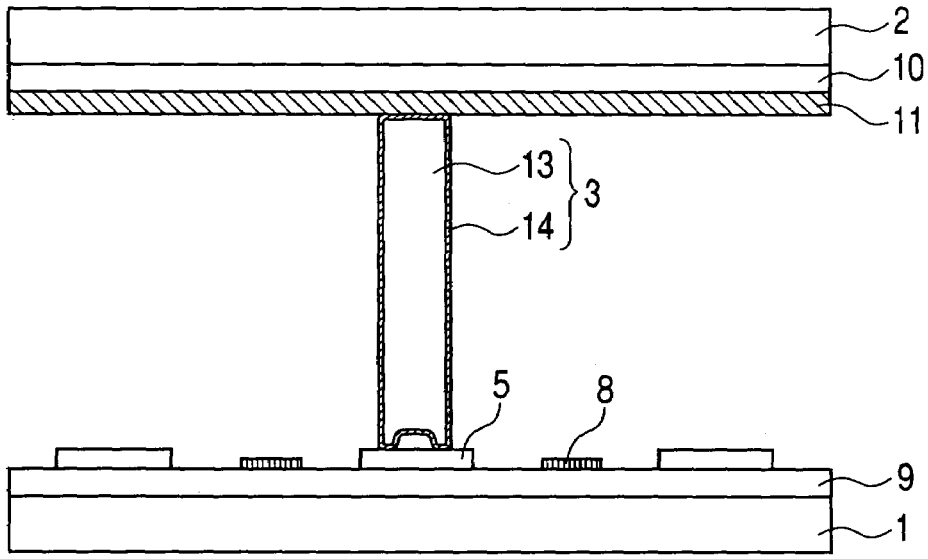
FIG. 1 is a local sectional view of a first embodiment in a direction orthogonal to a spacer.
Figure 2:
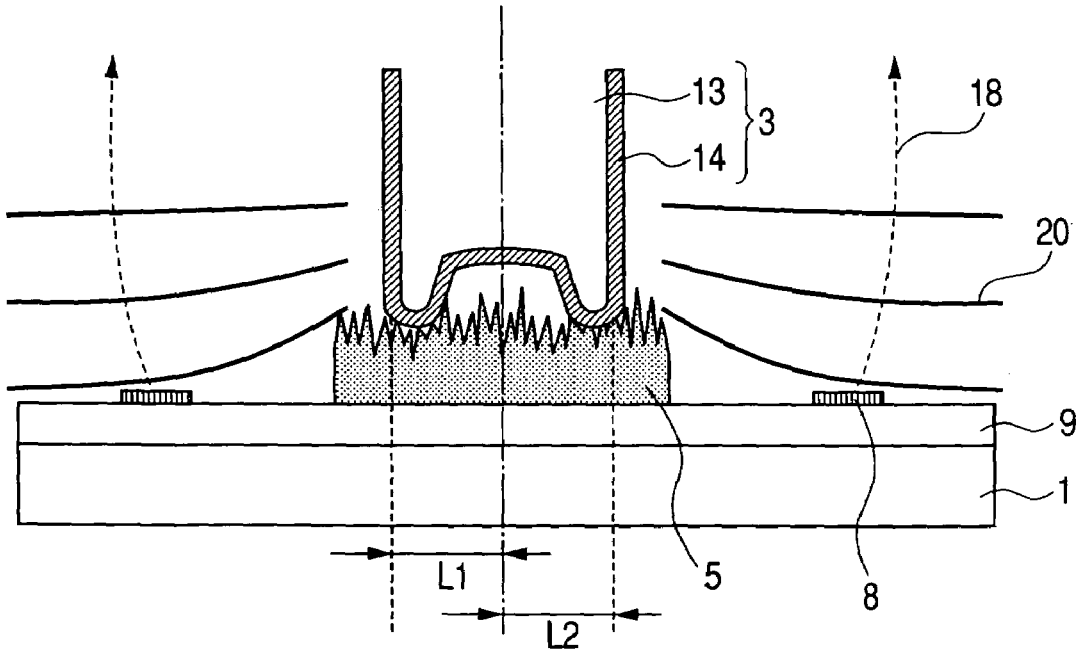
FIG. 2 is an illustration of a contact state between a resistance film and a wiring of the spacer in FIG. 1 and an electric field and an electron beam trajectory.

The above function is described below by using the embodiment in FIG. 1 to which the present invention is applied. The spacer 3 is held between a rear plate 1 and a face plate 2 and the resistance film 14 covering the surface of the spacer 3 is pressure-welded and electrically connected by a wiring (row-directional wiring 5 for this embodiment) serving as a first conductor at the rear plate side and metal backing 11 serving as a second conductor (conductive member) at the face plate 2 side. Electrical connection between the resistance film 14 and row-directional wiring 5 is performed as shown in FIG. 2. In this case, the equal potential line 20 nearby the rear plate 1 on the surface of the spacer 3 is schematically shown by a thick line. FIGS. 1 and 2 are sectional views showing the display panel (display apparatus) shown in FIG. 5 to be described later when cutting the spacer 3 by a plain including the electron emitting device 8 holding the spacer 3 and parallel with the normal line of the rear plate 1. (The sectional views of the spacer 3 are along a plane including a line extending between the election emitting devices 8 sandwiching the spacer 3 and being parallel to a normal line of the rear plate 1.) As shown in FIG. 2, the face covered with the resistance film 14 of the spacer 3 and connected to the row-directional wiring 5 is provided with a concave portion almost symmetric to the center line (two dot chain line in FIG. 2) of the spacer 3 parallel with the normal line direction of the rear plate 1 on a cross section when cutting the spacer 3 by a plain including the electron emitting device 8 holding the spacer 3 and parallel with the normal line of the rear plate 1. By using the above configuration, when assuming distances from the center line up to contact ends as L1 and L2, L1 is equal to L2. When the face covered with the resistance film of the spacer 3 and connected to the row-directional wiring 5 (face of the spacer facing the rear plate) is almost rectangular, a concave portion to be almost symmetric to the center line of the spacer 3 vertical to the longitudinal direction of the face and partitioning the short side of the face is formed on the face.

Because the row-directional wiring 5 has a potential of almost 0 V and the contact portion of the row-directional wiring 5 is present at a position upper than the electron emitting device 8 (face plate 2 side), the equal potential line 20 upper than the electron emitting device 8 becomes a curved line convex downward nearby the electron emitting portion of the electron emitting device 8.

Figure 10:
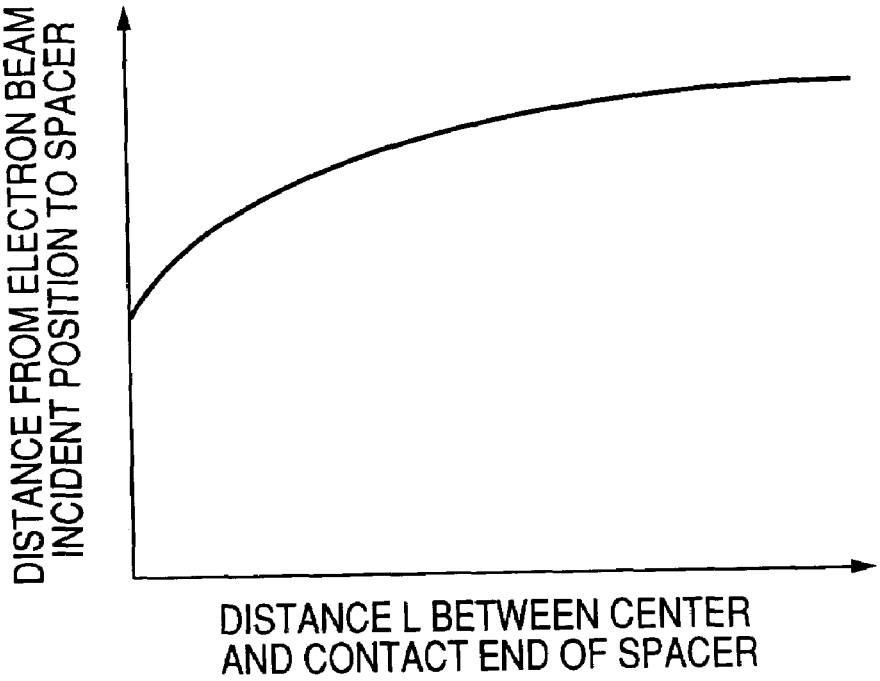
FIG. 10 is a graph showing a relation between the distance from the spacer of an electron beam and a contact position.
Figure 11:
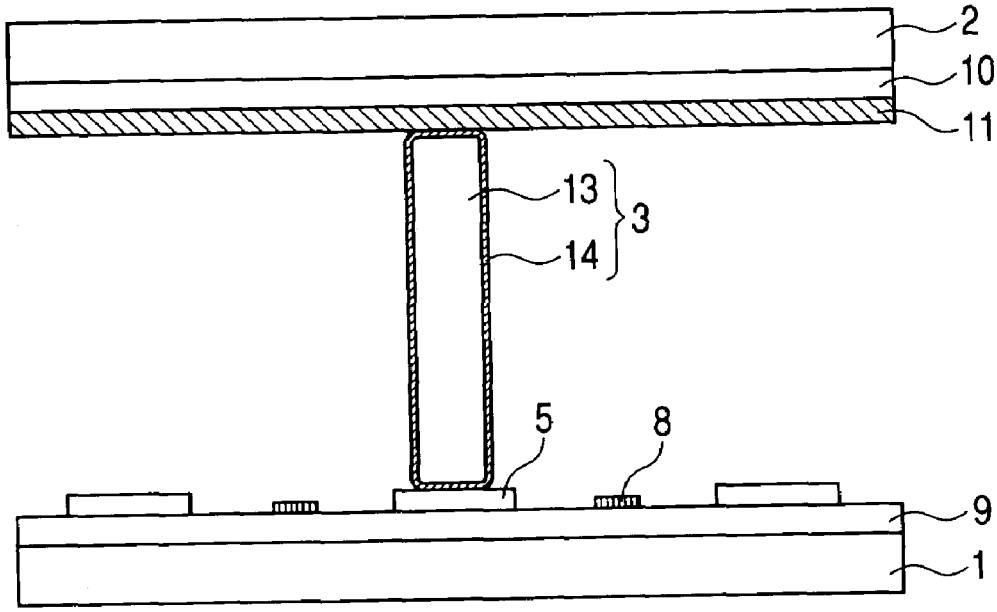
FIG. 11 is a local sectional view of a conventional spacer in an orthogonal direction.
Figure 12:
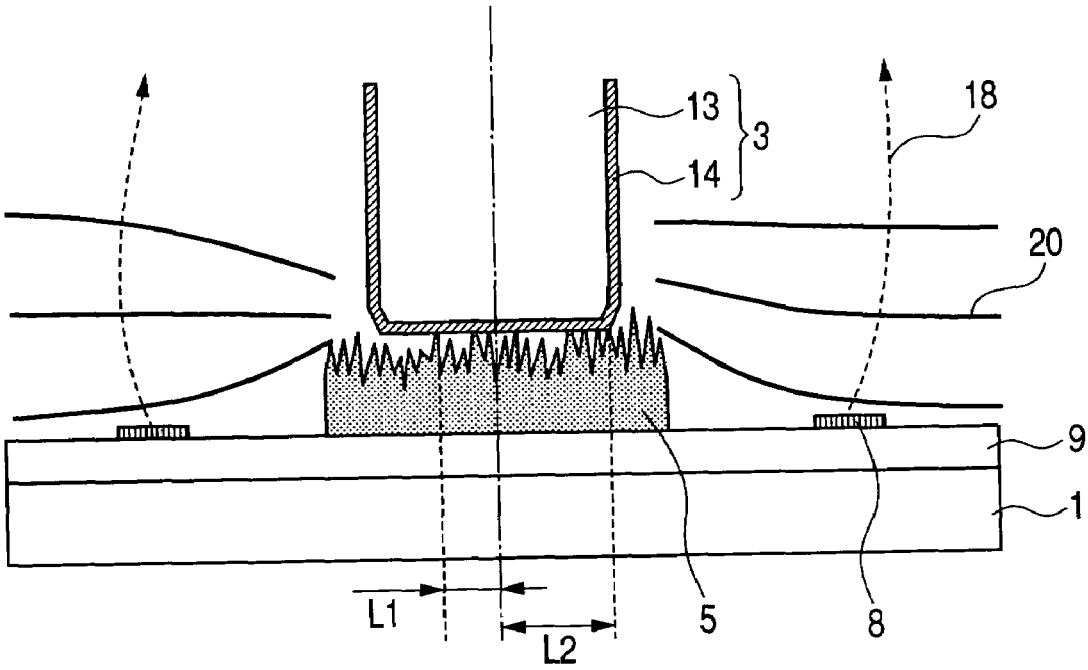
FIG. 12 is an illustration showing a contact state between the resistance film and wiring of the spacer in FIG. 11 and an electric field and an electron beam trajectory.

A component for an electron beam to approach the spacer 3 is decided by the contact state between the resistance film 14 and the row-directional wiring 5. When assuming the spacer width as W and the distance from the center of the spacer width up to a contact end as L, the component approaching the spacer 3 is a function of L and FIG. 10 shows the state. As shown in FIG. 10, as the distance from the center of the spacer width up to the contact end increases, the electron beam further gets away from the spacer 3. This is because the potential of each point of the resistance film 14 is decided by the ratio between creeping distances. For example, as shown in FIG. 12, when assuming distances from the center up to a contact end as L1 and L2, L1 becomes smaller than L2. Therefore, an electron beam at the L1 side has a trajectory for approaching the spacer 3 and an electron beam at the L2 side has a trajectory for getting away from the spacer 3.

In this case, the contact state between the resistance film 14 of the spacer 3 and row-directional wiring 5 and the concave shape of the spacer 3 are described below. In FIG. 12, the surface of the row-directional wiring 5 appears and height thereof depends on a place. Therefore, the contact position between the resistance film 14 and the row-directional wiring 5 does not become constant and the distance from the center of the spacer 3 up to a contact end is fluctuated and asymmetric. Moreover, the contact position is influenced by the assembling accuracy of the spacer 3. Therefore, it is preferable that a concave shape to be formed on the spacer 3 has a depth at which a contact position is not influenced by the surface state of the row-directional wiring 5. For example, it is preferable that the depth of the concave shape is larger than the average surface roughness of the row-directional wiring 5.

Moreover, when forming a concave shape on the spacer 3, the contact area between the resistance film 14 of the spacer 3 and the row-directional wiring 5 decreases and the pressure increases. Therefore, the electrical connection between the resistance film 14 and the row-directional wiring 5 becomes preferable and the potential is stabilized. Thus, there are effects for controlling the fluctuation of an electron beam and inhibiting the discharge due to unstable potential.

An embodiment of the present invention is described below by referring to the accompanying drawings.

Figure 5:
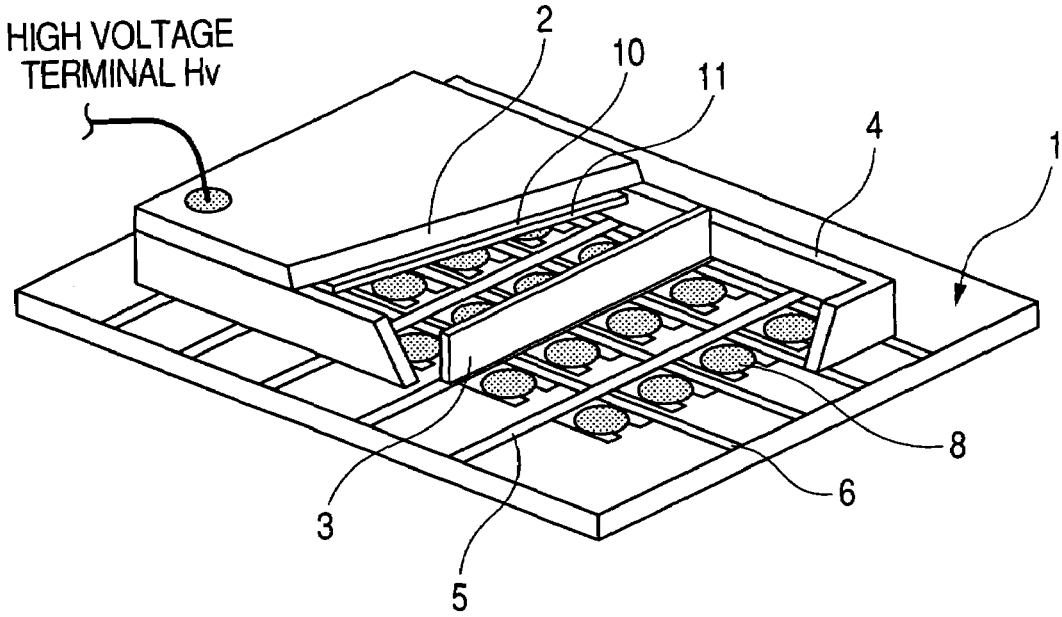
FIG. 5 is a perspective view of a display panel of the first embodiment of an image forming apparatus of the present invention, whose part is cut out.

FIG. 5 is a perspective view of a first embodiment of an image forming apparatus of the present invention in which a part of a display panel is cut out.

As shown in FIG. 5, the display panel of this embodiment is a panel in which the rear plate 1 serving as a first substrate and the face plate 2 serving as a second substrate are faced with each other by keeping an interval between them, the rib-like spacer 3 is inserted between them and the circumference of the spacer 3 is sealed by sidewalls 4 to bring the inside into a vacuum atmosphere.

The row-directional wiring 5, a column-directional wiring 6, an inter-wiring insulating layer (not illustrated), and the electron emitting device 8 are formed on the rear plate 1.

The illustrated electron emitting device 8 is a surface-conduction-type electron emitting device to which a conductive thin film having an electron emitting portion between a pair of device electrodes is connected. This embodiment has a multielectron beam source in which N×M surface-conduction-type electron emitting devices are arranged and matrix-wired by M row-directional wirings 5 and N column-directional wirings 6 formed at equal intervals.

Moreover, in the case of this embodiment, the row-directional wiring 5 is located on the column-directional wiring 6 through the inter-wiring insulating layer, a scanning signal is applied to the row-directional wiring 5, and a modulated signal (image signal) is applied to the column-directional wiring 6.

The row-directional wiring 5 and the column-directional electrode 6 can be respectively formed by applying silver paste to them in accordance with a screen printing method. Moreover, it is possible to form them by using a photolithography method.

It is possible to use various conductive materials as component materials of the row-directional wiring 5 and column-directional electrode 6 in addition to the above silver paste.

A fluorescent film 10 serving as an image forming member is formed on the downside (face opposite to rear plate 1) of the face plate 2. Because the display panel of this embodiment is a color display panel, three types of phosphors of three primary colors of red, green, and blue are separately applied to the fluorescent film 10. The phosphors are separately applied, for example, in stripe arrangement. A black conductor (black stripe) is set between stripes of the phosphors of three colors. Moreover, a method for separately applying phosphors of three primary colors can use not only the above stripe arrangement but also delta arrangement and other arrangements.

The metal backing (acceleration electrode) 11 serving as a conductive member set to the face plate 2 is set to the surface of the fluorescent film 10. The metal backing 11 is used to accelerate and raise electrons emitted from the electron emitting device 8. A high voltage is applied to the metal backing 11 from a high voltage terminal Hv and specified at a high potential compared to the row-directional wiring 5. In the case of the display panel of this embodiment using a surface-conduction-type electron emitting device as this embodiment, a potential difference of approx. 5 to 20 kV is normally formed between the row-directional wiring 5 and metal backing 11.

The rib-like spacer 3 is set onto the row-directional wiring 5 in parallel with the row-directional wiring 5. This spacer 3 is set onto the row-directional wiring 5.

A plurality of the spacers 3 are normally set in order to provide the atmosphere resistance for a display panel and held between the rear plate 1 having the electron source substrate 9 on which the electron emitting device 8 and the row-directional wiring 5 and column-directional wiring 6 for driving the device 8 are formed and the face plate 2 on which the fluorescent film 10 and metal backing 11 are formed and the upsides and downsides of the spacers 3 are respectively pressure-welded by the metal backing 11 and row-directional wiring 5. The sidewalls 4 are held by margins of the rear plate 1 and face plate 2 and the junction portions between the rear plate 1 and the sidewalls 4 and the junction portions between the face plate 2 and the sidewalls 4 are respectively sealed by frit glasses or the like.

Moreover, the spacer 3 is described below. The spacer 3 has an insulating characteristic capable of withstanding a high voltage to be applied between the row-directional wiring 5 and column-directional wiring 6 at the rear plate 1 side and the metal backing 11 at the face plate 2 side and has a conductivity for preventing electrification of the surface of the spacer 3. As shown in FIG. 1, the spacer 3 is constituted by a substratum 13 formed by an insulating material and the resistance film 14 for covering the surface of the base material 13.

As component materials of the base substance 13, for example, the following are used: quartz glass, glass whose impurity content such as Na is decreased, soda lime glass, and ceramics such as alumina. It is preferable to use the component material of this substratum 13 whose thermal expansion coefficient is equal to or close to that of the component material of the electron source substrate 9, rear plate 1, or face plate 2.

A current obtained by dividing the acceleration voltage Va to be applied to the metal backing 11 serving as the high potential side by the resistance value of the resistance film 14 is supplied to the resistance film 14 covering the surface of the spacer 3 and thereby, the electrification of the surface of the spacer 3 is prevented. Therefore, the resistance value of the resistance film 14 is set in a preferable range in accordance with electrification and power consumption. It is preferable to set the sheet resistance of the resistance film 14 to $10^{14}$ Ω/□ or less, more preferably to $10^{12}$ Ω/□ or less, and most preferably to $10^{11}$ Ω/□ or less from the viewpoint of electrification prevention. The lower limit of the sheet resistance of the resistance film 14 is influenced by the shape of the spacer 3 and a voltage to be applied across the spacer 3. To suppress the power consumption, it is preferable to set the sheet resistance to $10^5$ Ω/□ or more and more preferably to $10^7$ Ω/□ or more.

Though depending on the surface energy of a material constituting the resistance film 14, the adhesiveness with the substratum 13, or the temperature of the substratum 13, a thin film of 10nm or less is generally formed like an island shape whose resistance is unstable and which is inferior in reproducing characteristic. However, a film stress increases when the film thickness is 1 μm or more and the film removal hazardous nature rises and productivity is deteriorated because the film formation time is increased. Therefore, it is preferable that the film thickness of the resistance film 14 formed on the substratum 13 ranges between 10 nm and 1 μm and more preferable that the film thickness ranges between 50 and 500 nm. It is preferable that the sheet resistance is ρ/t (ρ: resistivity, t: film thickness) and the resistivity ρ of the resistance film 14 thus preferably ranges between 0.1 and $10^8$ Ωcm. Moreover, to realize more preferable ranges of the sheet resistance and the film thickness, it is preferable to set the resistivity ρ in a range between $10^2$ and $10^8$ Ωcm.

The temperature of the spacer 3 rises because a current flows through the resistance film 14 formed on the surface of the spacer 3 and the whole display panel produces heat during operation as described above. When the resistance temperature coefficient of the resistance film 14 is a large negative value, the resistance value decreases when the temperature rises and the current flowing through the resistance film 14 increases to cause a further temperature rise. Moreover, the current continuously increases until exceeding the limit of a power supply. The value of the resistance temperature coefficient at which the current runs away is a negative value and the absolute value is 1% or more. That is, it is preferable that the resistance temperature coefficient of the resistance film 14 is a value larger than −1%.

It is possible to use, for example a metal oxide as a component material of the resistance film 14. Among metal oxides, it is preferable to use a chromium oxide, nickel oxide, and copper oxide. This is because in the case of these oxides, the secondary electron emission efficiency is comparatively small and an electron emitted from the electron emitting device 8 is not easily electrified even if the electron hits the spacer 3. For substances other than these metal oxides, carbon is a preferable material because it has a small secondary electron emission efficiency. In particular, because amorphous carbon has a high resistance, a proper surface resistance of the spacer 3 can be easily obtained.

As another component material of the resistance film 14, in the case of nitride of an alloy of aluminum and transition metal, it is possible to control a resistance value in a wide range from a good conductor to an insulator by adjusting the composition of the transition metal and the nitride has a small change in resistance values in a display panel fabrication process and hence is stable. Therefore, the nitride is a preferable material. As transition metal elements, W, Ti, Cr, and Ta can be listed. Moreover, nitride of germanium and transition metal is preferable because it has a preferable electrical characteristic. Nitride of tungsten and germanium is a more preferable resistance film.

It is possible to form the above alloy nitride film in accordance with the thin film forming technique such as sputtering, electron beam vapor deposition, ion plating, or ion assist vapor deposition method. The above metal oxide film can be formed by a thin film forming method using an oxygen gas atmosphere. In addition, a CVD method and an alkoxide applying method can be used for forming the metal oxide film. A carbon film is formed by the vapor deposition method, sputtering method, CVD method, or plasma CVD method. In particular, an amorphous carbon film can be obtained so that hydrogen is included in the atmosphere during film formation or by using carbon hydride gas as film formation gas.

FIRST EMBODIMENT

Figure 3:
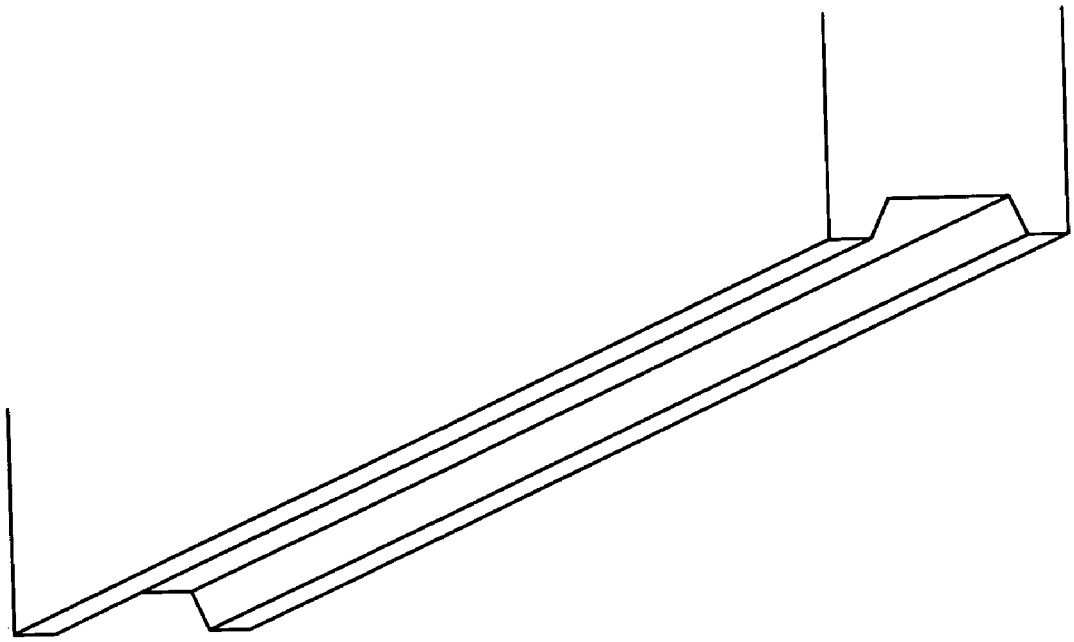
FIG. 3 is a local perspective view of the spacer in FIG. 1.

FIG. 1 is a local sectional view of the first embodiment viewed from the orthogonal direction (cutting the spacer 3 by a plain including the electron emitting device 8 holding the spacer 3 and parallel with the normal line of the rear plate 1), FIG. 2 is a detailed view of the contact portion between the resistance film and the row-directional wiring of the spacer in FIG. 1, and FIG. 3 is a local perspective view of the spacer in FIG. 1.

As shown in FIG. 1, the spacer 3 is held between the rear plate 1 and the face plate 2 and the resistance film 14 covering the surface of the spacer 3 is pressure-welded to the wiring (row-directional wiring 5 in the case of this embodiment) at the rear plate 1 side and the conductive member (metal backing 11 in the case of this embodiment) at the face plate 2 side and electrically connected to them. Electrical connection between the resistance film 14 and the row-directional wiring 5 is performed as shown in FIG. 2.

Figure 4:
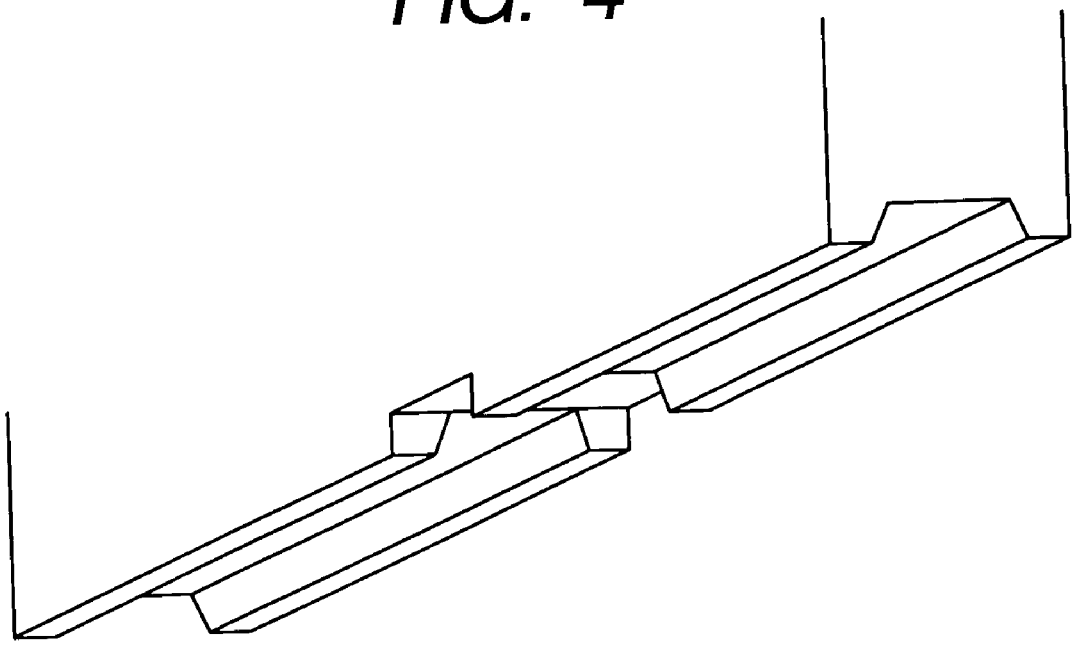
FIG. 4 is a local perspective view of the spacer in FIG. 1.

A concave shape is formed at the contact portion between the resistance film 14 and the row-directional wiring 5 on the spacer 3. It is preferable that the concave shape has a depth in which the contact position is not influenced by the surface state of the row-directional wiring 5. For example, as a condition, it is preferable that the depth of the concave shape is larger than the average surface roughness of the row-directional wiring 5. It is not always necessary that the concave shape is linear. As shown in FIG. 4, it is allowed to form one or more cruciform grooves in the middle of the concave shape in order to raise the exhaust efficiency for exhausting. The same is applied to a convex shape and it is allowed to form one or more cutouts in the middle of the convex shape.

In the case of the display panel described for this embodiment, as a result of setting the interval between the row-directional wirings at 5 to 920 μm, the width of the row-directional wiring at 5 to 690 μm, and the height from the electron emitting portion of the electron emitting device 8 up to the upside of the row-directional wiring at 5 to 75 μm, and measuring the surface roughness of the row-directional wiring 5 by a surface roughness gauge (Keyence ultradepth-shape measuring microscope VK-8510), the arithmetic average roughness is 2 μm. By considering the surface roughness, the depth and width of the concave portion of the contact portion of the spacer 3 with the row-directional wiring 5 is set to 20 μm and 200 μm, respectively, the total thickness of the spacer 3 is set to 300 μm, and the total height of the spacer 3 is set to 2.4 mm.

In this case, the arithmetic average roughness is based on the principle same as the calculation of a measured value by a surface roughness gauge. For details of the principle, refer to the description (Ra) in Item 4.2.1 Arithmetic average height of contour curved line in "JIS standard No. JISB0601 (2001)" Standard name "Geometric characteristic of product (GPS)—Surface aspect: Contour curved line system-Terminology, definition, and surface aspect parameter."

Moreover, the voltage applied to the metal backing 11 is set to 15 kV and the voltage applied between the row-directional wiring 5 and column-directional wiring 6 is set to 14 V. The spacer 3 is prepared by using the heating and drawing method. Furthermore, it is possible to further decrease the fluctuation of a contact position as the width of the contact face of the concave of the contact portion of the spacer 3 with the row-directional wiring 5 is smaller. However, it is preferable to properly decide the width in accordance with the pressure applied to the spacer 3 and the strength of the spacer 3.

As described above, by applying the present invention to a display panel, it is possible to display a preferable image free from a deflection due to a spacer.

SECOND EMBODIMENT

In the case of second embodiment of the present invention, only points different from the first embodiment are described.

Figure 6:
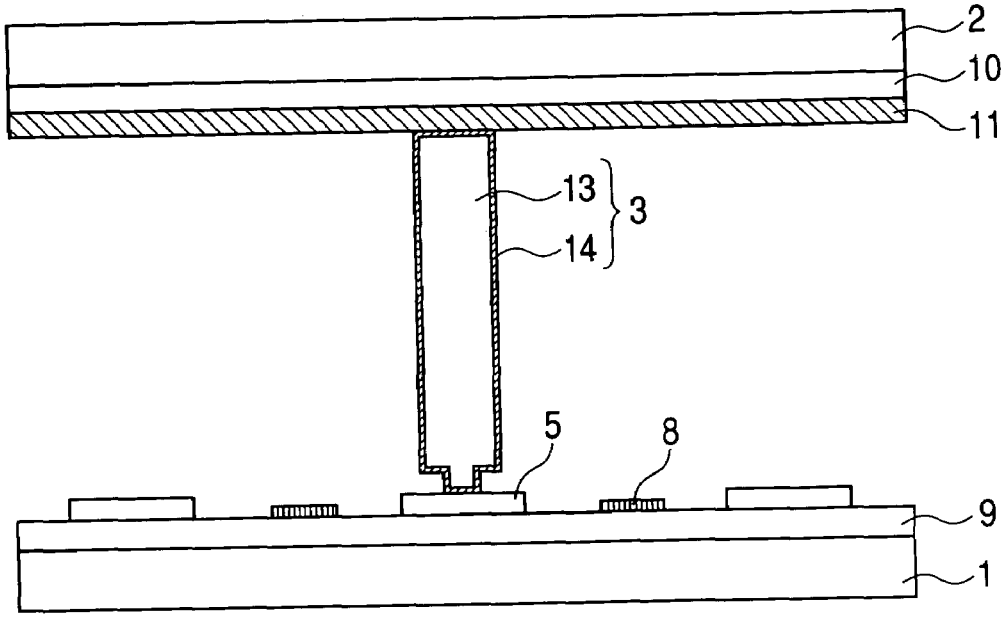
FIG. 6 is a local section view of a second embodiment in FIG. 2 in a direction orthogonal to a spacer.
Figure 7A:
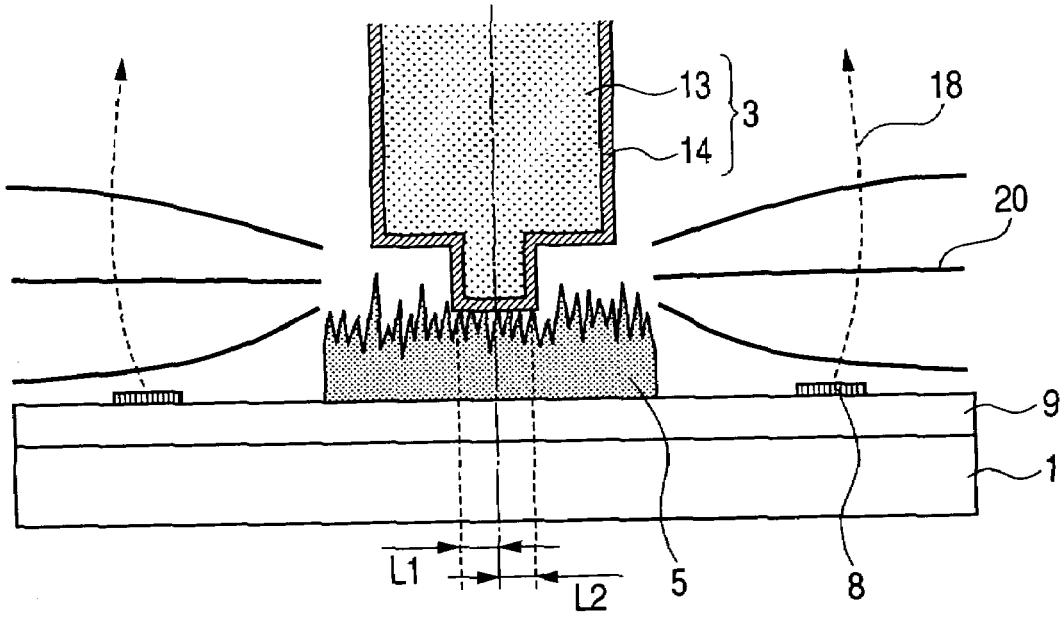
FIG. 7A is an illustration showing a contact state between a resistance film and a wiring of the spacer in FIG. 6 and an electric field and an electron beam trajectory.
Figure 8A:
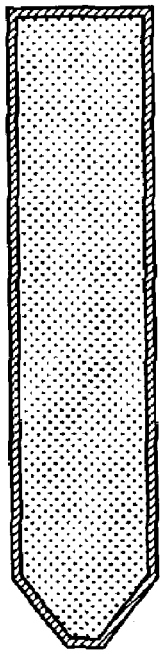
FIGS. 8A and 8B are schematic views showing modifications of the spacer of the second embodiment.
Figure 8B:
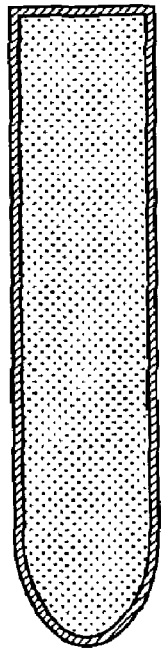

FIG. 6 is a local sectional view of the spacer of the second embodiment viewed from the orthogonal direction, FIG. 7A is a detailed view of the contact portion between the resistance film of the spacer in FIG. 6 and a row-directional wiring, and FIGS. 8A and 8B are schematic views showing other shapes of the spacer of the second embodiment. This embodiment is different from the first embodiment in that the contact portion between the resistance film 14 of the spacer 3 and the row-directional wiring 5 is formed into a convex shape. By using this configuration, it is possible to obtain an area in which the resistance film 14 contacts with the row-directional wiring 5, thereby decreasing the fluctuation of a contact position.

Also in the case of the second embodiment, it is necessary for a convex shape to be formed on the spacer 3 to have a height at which a contact position is not influenced by the surface state of the row-directional wiring 5 similarly to the case of the first embodiment. For example, as a condition, it is preferable that the height of the convex shape is larger than the average surface roughness of the row-directional wiring 5. Moreover, the point that it is possible to further decrease the fluctuation of a contact position as the width of the contact face of the contact portion of the spacer 3 with the row-directional wiring 5 is smaller is the same as the case of the first embodiment. However, a point which must be considered is that the creeping distance is changed due to a shape in the case of a convex shape in addition to the pressure applied to the spacer 3 and the tolerance of fluctuation. Therefore, it is preferable to properly decide the convex shape by including the achievable distance of an electron beam.

Figure 7B:
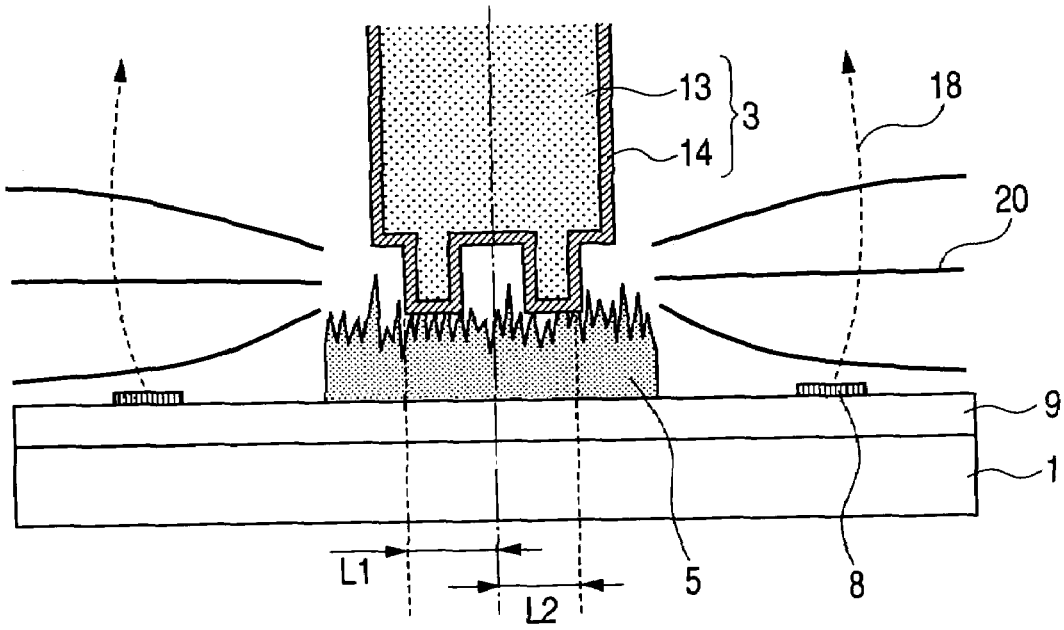
FIG. 7B is a schematic view showing a modification of the spacer of the second embodiment.

Moreover, by using the configuration in FIG. 7B, the controllability of the achievable distance of an electron beam is further improved. Thus, this is a method for improving the objectiveness to a spacer at a contact position and more accurately controlling L1 and L2 by forming two convex portions each having a contact area approx. half of the area in FIG. 7A.

Furthermore, it is preferable to decide the angle of taper by paying attention to the above-described point even in the case of the shapes in FIGS. 8A and 8B.

In the case of the spacer 3 described for this embodiment, the total thickness of the spacer 3 is set to 300 μm, the total height of the spacer 3 is set to 2.4 mm, the height of the convex portion of the contact portion with the row-directional wiring 5 of the spacer 3 is set to 20 μm and the width of the contact face of the of the convex portion of the contact portion with the row-directional wiring 5 of the spacer 3 is set to 100 μm. It is possible to decrease the fluctuation of the contact position as the width of the contact face of the convex portion of the contact portion with the row-directional wiring 5 of the spacer 3 is decreased. However, it is preferable to properly decide the width in accordance with the pressure applied to the spacer 3 and the strength of the spacer.

As described above, by applying the present invention to a display panel, it is possible to display an image free from the deflection of the image due to a spacer.

THIRD EMBODIMENT

Only points of third embodiment different from those of the first and second embodiments are described below. The configuration of the third embodiment is similar to the configuration of the embodiment 1 in FIG. 1.

Figure 7C:
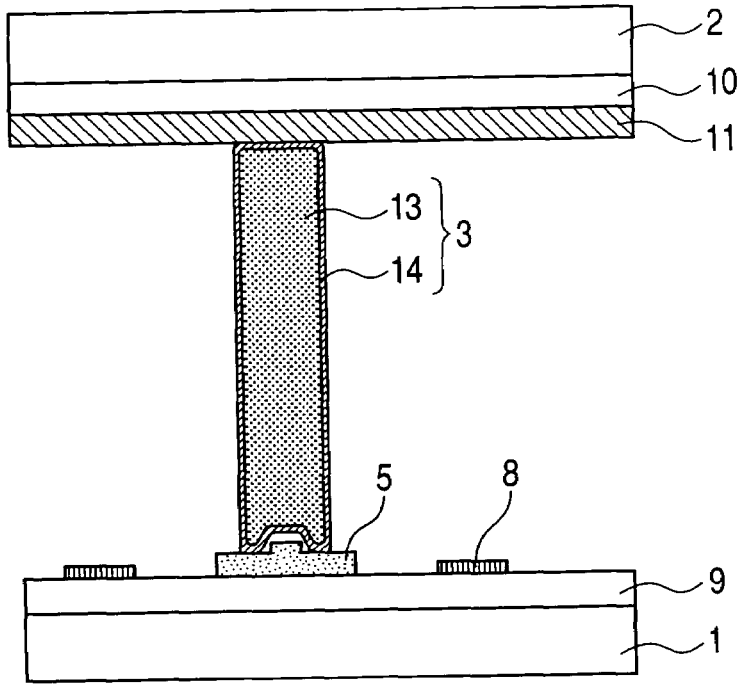
FIG. 7C is a local sectional view of a 2-1th embodiment in the direction orthogonal to a spacer.

FIG. 7C is a local sectional view of the spacer of the third embodiment viewed from the orthogonal direction, in which the spacer is the same as that in FIG. 1 but the shape of the row-directional wiring 5 is different. As shown in FIG. 7C, by forming a protrusion on the row-directional wiring 5, the protrusion functions as a positioning guide and spacer setting becomes easy.

FOURTH EMBODIMENT

Only points of fourth embodiment of the present invention different from those of the first, second and third embodiments are described below. The configuration of the fourth embodiment is similar to the configuration of the embodiment 2 in FIG. 6.

Figure 7D:
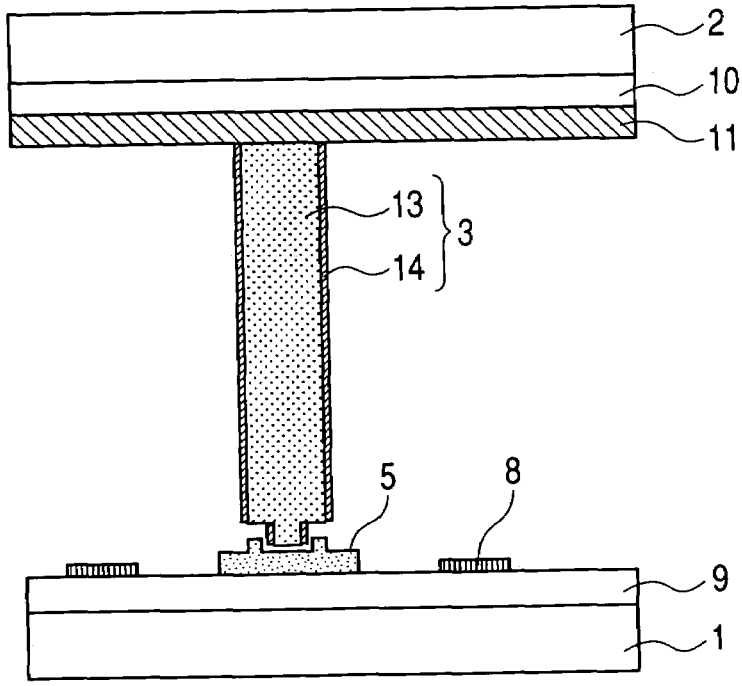
FIG. 7D is a local sectional view of a 2-2th embodiment in the direction orthogonal to a spacer.

FIG. 7D is a local sectional view of the spacer of the fourth embodiment viewed from the orthogonal direction, in which the spacer is the same as that in FIG. 6 but the shape of the row-directional wiring 5 is different. As shown in FIG. 7D, by forming two protrusions on the row-directional wiring 5, they function as positioning guides and spacer setting becomes easy.

In the case of this example, because the height of the convex portion of the spacer is larger than the protrusion of the wiring, the contact position between the spacer and the wiring is decided by the convex portion of the spacer. Similarly to the above-described embodiment 2, the convex portion of the spacer includes electron emitting devices for holding the spacer and the contact position between the spacer and the wiring becomes symmetric to the center line of the spacer and is symmetric to the center line of the spacer parallel with the normal line of a rear plate. Therefore, the contact position between the spacer and the wiring is symmetric to the center line of the spacer. Thereby, because the potential distribution on the surface of the spacer becomes an object, the trajectory of electron beams emitted from the electron emitting device do not get out of order.

Figure 7E:
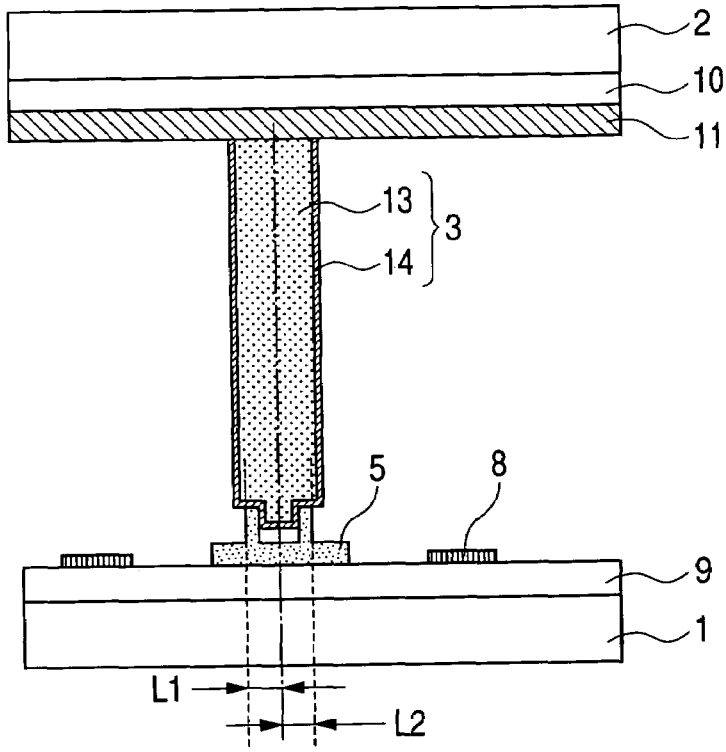
FIG. 7E is a local sectional view of the 2-2th embodiment in the direction orthogonal to a spacer.

Moreover, FIG. 7E is another shape of the row-directional wiring 5. By increasing the height of the protrusion, that is, the height of the guide on the row-directional wiring 5 as shown in FIG. 7E, positioning becomes easier.

In the case of the configuration in FIG. 7E, because the height of the protrusion of the wiring is larger than that of the convex portion of the spacer, the contact position between the spacer and the wiring is decided by the protrusion of the wiring. Also in the case of this configuration, because the convex portion of the spacer includes electron emitting devices for holding the spacer and is symmetric to the center line of the spacer parallel with the normal direction of the rear plate at the cross section when cutting the spacer on a plane parallel with the normal line of the rear plate. Therefore, the contact position between the spacer and the wiring becomes symmetric to the center line of the spacer. Thereby, because the potential distribution of the spacer becomes an object, the trajectory of electron beams emitted from the electron emitting devices does not get out of order.

FIFTH EMBODIMENT

Only points of fifth embodiment of the present invention different from those of the first, second, third and fourth embodiments are described.

The configuration of the fifth embodiment is similar to the configuration of the third embodiment in FIG. 7B.

Figure 7F:
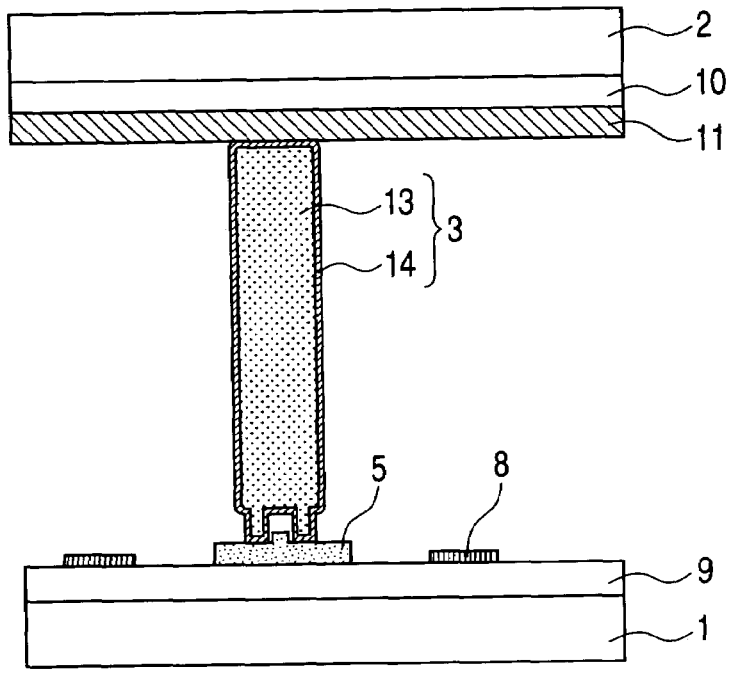
FIG. 7F is a local sectional view of a 2-3th embodiment in the direction orthogonal to a spacer.

FIG. 7F is a local sectional view of the spacer of the third embodiment viewed from the orthogonal direction, in which a spacer is the same as that in FIG. 7B but the shape of the row-directional wiring 5 is different. As shown in FIG. 7F, by forming a protrusion on the row-directional wiring 5, it functions as a positioning guide and spacer setting becomes easier.

SIXTH EMBODIMENT

Only points of sixth embodiment of the present invention different from those of the first, second, third, fourth and fifth embodiments are described below.

Figure 9:
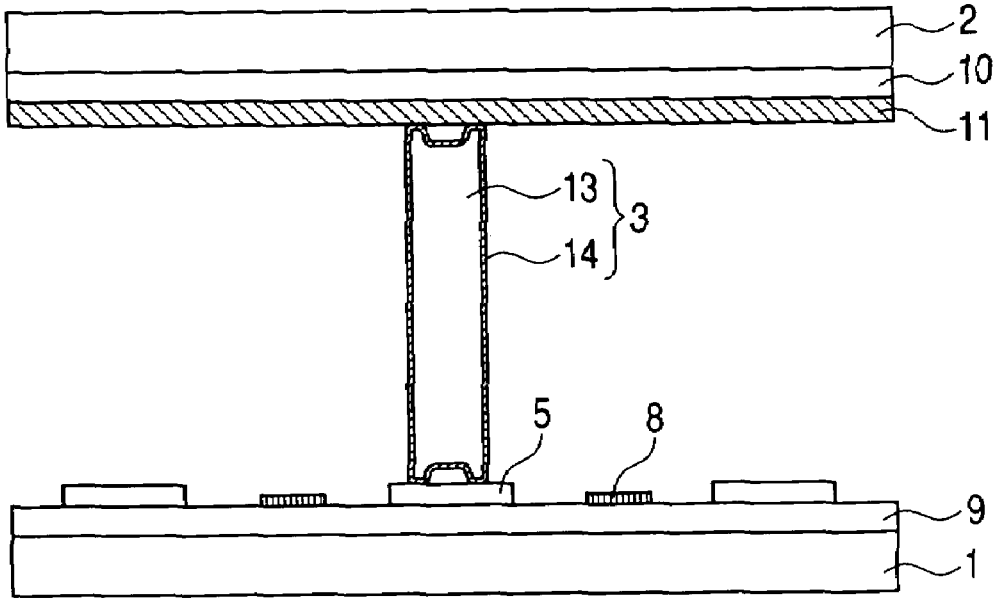
FIG. 9 is a local sectional view of third embodiment in a direction orthogonal to a spacer.

FIG. 9 is a local sectional view of the spacer of the sixth embodiment viewed from the orthogonal direction. This embodiment is an example in which contact control of the spacer 3 shown in the first embodiment is applied to the rear plate 1 side and the face plate 2 side.

Also in the case of the contact control at the face plate 2 side, the idea of the contact control at the rear plate 1 side described for the first and second embodiments can be applied.

Moreover, in the case of the above embodiments, the resistance film 14 of the spacer 3 is brought into contact with the row-directional wiring 5 at the rear plate 1 side. However, when the column-directional wiring 6 is exposed to the surface, it is also possible to bring the resistance film 14 into contact with the column-directional wiring 6.

In the case of this embodiment, the following are known as an electron emitting device: a field-emitting type (FE-type) device, metal/insulating-layer/metal-type (MIM-type) emitting device and an electron-beam emitting device using a carbon nano-tube. It is allow to use any one of these electron emitting devices.

Moreover, the present invention restrains the fluctuation of a potential due to a voltage drop according to a contact position from the center of a spacer. According to this idea, the present invention is not restricted to an image forming apparatus but it can be applied to an apparatus having no image forming member and an apparatus having no image forming member is also included in an electronic apparatus.

The above-described display apparatus of the present invention can be applied to a TV set. A TV set to which an image display apparatus of the present invention is applied is described below.

Figure 13:
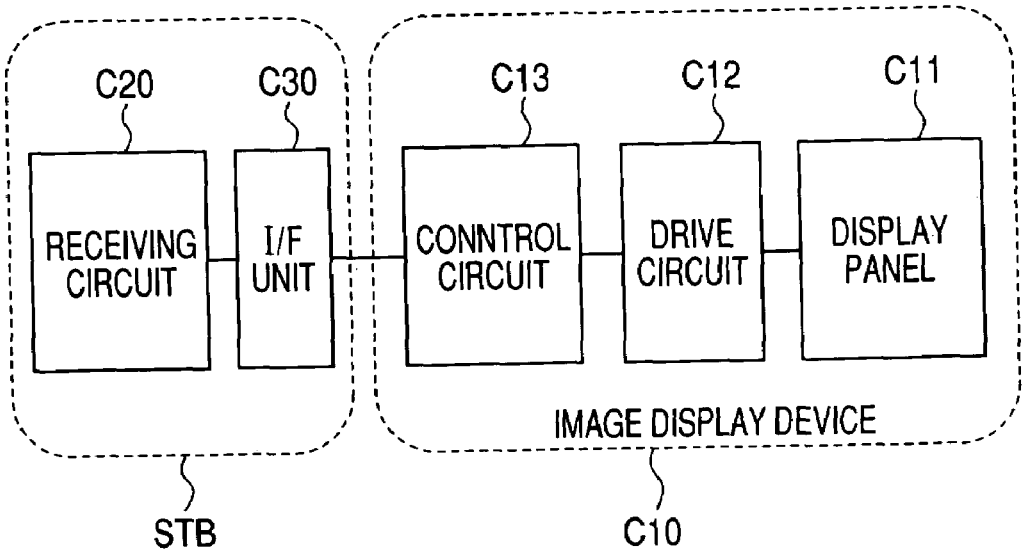
FIG. 13 is a block diagram for explaining a television apparatus of the present invention.

FIG. 13 is a block diagram of a television apparatus of the present invention. A receiving circuit C20 is constituted by a tuner and a decoder, which receives a television signal of satellite broadcasting or ground wave or data broadcasting through a network and outputs decoded image data to an I/F unit (interface portion). An I/F unit C30 converts image data into the display format of a display apparatus and outputs the display image to a display apparatus. A display apparatus C10 is constituted by a display panel, driving circuit and control circuit and the image display apparatus in FIG. 5 can be used. A control circuit C13 applies image processing such as correction processing suitable for the display panel to input image data and outputs image data and various control signals to the driving circuit. The correction processing includes the processing for retraining fluctuations of a pixel nearby a spacer and a pixel separate from the spacer and it is preferable that the control circuit C13 has a luminance correction circuit. A driving circuit C12 outputs a driving signal to a display panel C11 in accordance with input image data and a television image is displayed on the display panel C11.

It is allowed that the receiving circuit and I/F unit are stored in a housing separate from the display apparatus as a set top box (STB) or stoked in the same housing as the display apparatus.

This application claims priority from Japanese Patent Application No. 2004-014468 filed on Jan. 22, 2004, which is hereby incorporated by reference herein.

What is claimed is:

1. An electron beam apparatus comprising:

a first substrate having a plurality of electron emitting devices and a first conductor held between some of the electron emitting devices and set at a low potential;

a second substrate disposed in opposition to the first substrate and having a second conductor set at a potential higher than that of the first conductor; and a spacer disposed along the first conductor and covered with a resistance film contacting the first conductor and the second conductor, wherein a surface covered with the resistance film of the spacer at the side contacting the first conductor and/or second conductor has a concave portion arranged to be almost symmetric with respect to a center line of the spacer parallel to a normal line of the first substrate and/or second substrate, and the center line being within the cross section of the spacer along a plane parallel to the normal line and including the electron emitting devices disposed in sandwiching the spacer, wherein the height of the concave portion is larger than the surface roughness of the first conductor and/or second conductor.

2. The electron beam apparatus according to claim 1, wherein the first conductor is electrically connected with at least some of the electron emitting devices.

3. The electron beam apparatus according to claim 1, wherein the electron emitting devices are two-dimensionally arranged, the first conductor is a wiring to be connected with the electron emitting devices arranged in one direction and the second conductor is an acceleration electrode for accelerating a electron emitted from the electron emitting devices.

4. The electron beam apparatus according to claim 1, wherein the second substrate has an image forming member for forming an image in accordance with irradiation of electrons.

5. An image display apparatus comprising:

a first substrate having a plurality of electron emitting devices and a first conductor held by some of the electron emitting devices and set at a low potential;

a second substrate having a second conductor set to the first substrate disposed in opposition to the first substrate and set at a potential higher than that of the first conductor and an image forming member for forming an image in accordance with irradiation of an electron beam emitted from the electron emitting device;

a spacer disposed along the first conductor between the first substrate and the second substrate and covered with a resistance film contacting the first conductor and the second conductor; wherein a surface covered with the resistance film of the spacer at the side contacting the first conductor and/or second conductor has a concave portion arranged to be almost symmetric with respect to a center line of the spacer parallel to a normal line of the first substrate and/or second substrate, and the center line being within the cross section of the spacer along a plane parallel to the normal line and including the electron emitting devices sandwiching the spacer, wherein the height of the concave portion is larger than the surface roughness of the first conductor and/or second conductor.

6. A television apparatus comprising the image display apparatus of claim 5, a television signal receiving circuit and an interface portion for connecting the image display apparatus with the television signal receiving circuit.

7. The television apparatus according to claim 6, wherein the image display apparatus has a circuit portion for restraining the luminance fluctuation due to the spacer and the circuit portion corrects an image signal from the interface portion.

* * * * *